US006358657B1

(12) United States Patent
Silence et al.

(10) Patent No.: US 6,358,657 B1
(45) Date of Patent: Mar. 19, 2002

(54) TONER BINDER OF POLYESTER HAVING A HIGH MELT FLOW INDEX AND TONERS THEREFROM

(75) Inventors: Scott M. Silence, Fairport; Joo T. Chung; James M. Proper, both of Webster; John J. Ianni, Medina; Jeffrey H. Sokol, Pittsford; Hui Chang, Pittsford, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/930,501

(22) Filed: Aug. 16, 2001

Related U.S. Application Data

(63) Continuation-in-part of application No. 09/671,997, filed on Sep. 29, 2000.

(51) Int. Cl.[7] ..... G03G 9/087
(52) U.S. Cl. ..... 430/109.4; 430/45
(58) Field of Search ..... 430/109.4, 109.1, 430/45

(56) References Cited

U.S. PATENT DOCUMENTS

| | | | | | |
|---|---|---|---|---|---|
| 3,590,000 | A | | 6/1971 | Palermiti et al. | 252/62.1 |
| 3,847,604 | A | | 11/1974 | Hagenbach et al. | 96/150 |
| 4,298,672 | A | | 11/1981 | Lu | 430/108 |
| 4,338,390 | A | | 7/1982 | Lu | 430/106 |
| 4,868,600 | A | | 9/1989 | Hays et al. | 355/239 |
| 4,935,326 | A | | 6/1990 | Creatura et al. | 430/108 |
| 4,937,166 | A | | 6/1990 | Creatura et al. | 430/108 |
| 5,227,460 | A | | 7/1993 | Mahabadai et al. | 528/272 |
| 5,352,556 | A | | 10/1994 | Mahabadi et al. | 430/109 |
| 5,376,494 | A | | 12/1994 | Mahabadi et al. | 430/137 |
| 5,395,723 | A | | 3/1995 | Mahabadi et al. | 430/109 |
| 5,401,602 | A | | 3/1995 | Mahabadi et al. | 430/137 |
| 5,545,501 | A | | 8/1996 | Tavernier et al. | 430/106.1 |
| 5,601,960 | A | * | 2/1997 | Mahabadi et al. | 430/137 |
| 5,750,909 | A | * | 5/1998 | Hawkins et al. | 430/137 |
| 5,978,633 | A | | 11/1999 | Hirsch et al. | 399/266 |
| 6,063,827 | A | | 5/2000 | Sacripante et al. | 522/6 |
| 6,177,221 | B1 | | 1/2001 | Maniar et al. | 430/108 |

* cited by examiner

*Primary Examiner*—John Goodrow
(74) *Attorney, Agent, or Firm*—Oliff & Berridge, PLC; Eugene O. Palazzo

(57) ABSTRACT

A toner having a high colorant concentration and a binder resin that includes a polyester resin having linear portions and crosslinked portions of high density crosslinked micro-gel particles has a melt flow index value of about 11±MFI units. The binder resin may also include a mixture of two polyester resins having different MFI values.

28 Claims, No Drawings

TONER BINDER OF POLYESTER HAVING A HIGH MELT FLOW INDEX AND TONERS THEREFROM

The present application is a continuation-in-part of U.S. application Ser. No. 09/671,997, filed Sep. 29, 2000 allowed. The entire disclosure of this prior application is hereby incorporated by reference herein in its entirety.

BACKGROUND OF THE INVENTION

1. Field of the Invention

The present invention is generally directed to a toner containing binder resin and colorant in which the binder resin is a polyester having both low molecular weight, high melt flow index value linear portions and crosslinked portions, as well as developer containing such toner. More specifically, the present invention relates to a toner having a high loading amount of colorant and a polyester resin binder that contains both linear and crosslinked portions, but which has a satisfactorily high melt flow index to enable longer fuser roll life while simultaneously minimizing the presence of objectionable gloss non-uniformity defects in the prints produced by a xerographic engine.

2. Discussion of Related Art

Toners comprised of binder resins that include a linear portion as well as a portion of crosslinked microgel particles are kown. U.S. Pat. Nos. 5,227,460, 5,352,556, 5,376,494, 5,395,723 and 5,401,602, each incorporated herein by reference in its entirety, describe a low melt toner resin with low minimum fix temperature and wide fusing latitude that contains a linear portion and a crosslinked portion containing high density crosslinked microgel particles, but substantially no low density crosslinked polymer. It is described that the resin may be formed by reactive melt mixing under high shear and high temperature of an unsaturated polyester resin such as a poly(propoxylated bisphenol A fumarate) in the presence of a chemical initiator that hag been mixed into the polyester.

U.S. Pat. No. 6,063,827, incorporated herein by reference in its entirety, describes a process for the preparation of an unsaturated polyester which comprises (i) reacting an organic diol with a cyclic alkylene carbonate in the presence of a first catalyst to thereby form a polyalkoxy diol, (ii) optionally adding thereto a further amount of cyclic alkylene carbonate in the presence of a second catalyst, and (iii) subsequently polycondensing the resulting mixture with a dicarboxylic acid. The unsaturated polyester formed may then be further subjected to crosslinking with an initiator as in the patents described immediately above in order to form a toner resin.

Co-pending U.S. application Ser. No. 09/520,439, filed Mar. 7, 2000 allowed an incorporated by reference herein in its entirety, describes toners and developers for particular use in devices utilizing hybrid scavengeless development, the toners including toner particles of at least one binder, at least one colorant, and optionally one or more additives, the toner exhibiting a charge per particle diameter (Q/D) of from −0.1 to −1.0 fC/μm with a variation during development of from 0 to 0.25 fC/μm and the distribution is substantially unimodal and possesses a peak width of less than 0.5 fC/μm, and the toner has a triboelectric charge of from −25 to −70 μC/g with a variation during development of from 0 to 15 μC/g following triboelectric contact with carrier particles. A desired range of rheology or melt flow index (MFI) for a toner is also described. The developer of a mixture of carrier particles and the toner particles has a triboelectric value of from −35 to −60 μC/g, a charge distribution (Q/D) of from −0.5 to −1.0 fC/μm and the distribution is substantially unimodal and possesses a peak width of less than 0.5 fC/μm, preferably less than 0.3 fC/μm, and a conductivity of the developer ranges from $1\times10^{-11}$ to $10\times10^{-15}$ mho/cm as measured at 30 V. The method of forming the toner having controlled properties includes feeding at least one binder and at least one colorant into a mixing device at a feed ratio, then upon exit of the mixture from the mixing device, monitoring one or more properties of the mixture with at least one monitoring device, wherein if the monitoring indicates that the one or more properties being monitored is out of specification, removing the monitored mixture from the method and adjusting the feed ratio by adjusting the feeding of the at least one binder or of the at least one colorant, thereby retaining in-specification mixture in the method, grinding the in-specification mixture, optionally together with a portion of one or more external additives to be added to the mixture, classifying the ground in-specifcation mixture, and mixing the classified in-specification mixture with one or more external additives to obtain the toner having controlled properties.

Co-pending U.S. application Ser. No. 09/695,861, filed Oct. 26, 2000 allowed and incorporated by reference herein in its entirety, describes a toner resin having linear portions and crosslinked portions of high density microgel particles, where the linear portions of the toner resin are an unsaturated polyester resin, preferably poly(propoxylated bisphenol A fumarate). The toner resin is prepared so that the crosslinked resin achieved contains less than 0.20 percent by weight of acids. In particular, the crosslinked toner resin is free of benzoic acid. The method of making the toner resin includes (a) spraying a liquid chemical initiator such as 1,1-bis(t-butyl peroxy)-3,3,5-trimethylcyclohexane onto the unsaturated polyester resin prior to, during or subsequent to melting of the unsaturated polyester resin to form a polymer melt; and (b) subsequently crosslinking the polymer melt under high shear to form the crosslinked toner resin. The resin is reported to most preferably have a rheology such that the MFI is about 18 to about 20 g/10 min at 125° C. and 16.6 kg load, preferably about 19.5 g/10 min.

Co-pending U.S. application Ser. No. 09/671,997, filed Sep. 29, 2000 and incorporated by reference herein in its entirety, describes at least three differently colored toners, designed for use together in forming a color image in an image developing device, that have substantially the same melt flow index value. By substantially matching the melt flow index values of at least three toners of a set of toners, it has been found that the resultant color image has an overall excellent image quality, i.e., an excellent overall gloss level without any gloss banding. The toners may be made to have substantially the same melt flow index value in a carefully controlled process that includes forming a single toner by feeding at least one binder and at least one colorant into a mixing device to form a mixture, upon exit of the mixture from the mixing device, measuring a rheology property of the mixture with at least one monitoring device, and comparing the measured rheology property to a target property range that the measured rheology property must be within in order for the single toner to achieve the desired melt flow index value, wherein if the measuring indicates that the rheology property is outside of the target property range, feed amounts of the at least one binder or of the at least one colorant into the mixing device are adjusted, grinding the mixture, optionally together with a portion of one or more external additives to be added to the mixture, classifying the ground mixture, mixing the classified mixture with one or more external surface additives to obtain the single toner having the desired melt flow index value, and repeating the steps for each additional differently colored toner.

As discussed in this co-pending application, by carefully controlling the melt flow index values to be substantially the same for as many of the different color toners that develop a color image in the same device as possible, the resultant color image has an overall excellent image quality. In particular, the color image has an excellent overall gloss level and does not exhibit any differential gloss (distinctly different glosses among different colors) or gloss banding (variations in gloss from one area of an image to another within a single color). The melt flow index (MFI) is a value identifying the rheology, or viscoelasticity, of the toner. MFI as used herein is defined as the weight of a toner (in grains) which passes through an orifice of length L and diameter D in a 10 minute period with a specified applied load, unless otherwise indicated.

However, some toners require the presence of high amounts of colorant (e.g., pigment) in order for the toner to exhibit satisfactory gloss. For example, as noted in this co-pending application, yellow toner requires a higher amount of colorant than the other traditional colors (cyan, magenta and black) of a four color toner set. The amount of colorant inversely impacts the MFI of the toner, i.e., the more colorant that is present in the toner, the lower is the MFI of the toner. For toners having higher loading amounts of colorant, it is thus difficult to achieve a final toner having a satisfactorily high MFI.

What is still desired is a toner composition that contains higher amounts of colorant and still also exhibits a satisfactorily high MFI.

SUMMARY OF THE INVENTION

It is thus an object of the present invention to develop a toner composition that possesses a satisfactorily high melt flow index at higher colorant loadings.

It is a still further object of the present invention to develop a toner composition that exhibits high gloss and also lengthens a fuser roll life.

It is a still further object of the present invention to develop a toner composition that is able to match melt flow index and gloss properties of other toner compositions to be used together in a developer set of toners, despite different colorant loading amounts among the different toner compositions within the developer set.

These and other objects are achieved by the present invention, wherein in embodiments the invention relates to a toner comprising a binder and at least one colorant, wherein the binder comprises a polyester resin having linear portions and crosslinked portions of high density crosslinked microgel particles, wherein the linear portions have a melt flow index value of at least about 40 MFI units, wherein the binder contains at least about 5% by weight of the crosslinked portions, wherein the at least one colorant comprises at least about 6% by weight of the toner exclusive of any surface additives, and wherein the toner has a melt flow index value of about 11±3 MFI units.

In further embodiments, the invention relates to a toner comprising a binder component and at least one colorant, wherein the at least one colorant comprises at least about 6% by weight of the toner exclusive of any surface additives, wherein the binder component comprises about 10% to about 70% by weight of a first polyester resin having a melt flow index value of from about 25 to about 35 MFI units and about 30% to about 90% by weight of a second polyester resin having a melt flow index value of at least about 40 MFI units, and wherein the toner has a melt flow index value of about 11±3 MFI units.

In still further embodiments, the invention relates to a developer set comprising at least four differently colored toners for use together in a same image developing device, wherein each of the at least four differently colored toners comprises a binder component and at least one colorant, wherein each of the at least four differently colored toners has a melt flow index value of about 11±3 MFI units, and wherein at least one of the differently colored toners comprises a toner according to the present invention.

DETAILED DESCRIPTION OF PREFERRED EMBODIMENTS

As noted above, the melt flow index (MFI) is a value identifying the rheology, or viscoelasticity, of the toner. MFI as used herein is defined as the weight of a toner (in grams) which passes through an orifice of length L and diameter D in a 10 minute period with a specified applied load. In the present invention, unless otherwise noted, the conditions for determining the MFI of a toner are a temperature of 117° C., an applied load of 2.16 kilograms, and an L/D die ratio of 3.8. An MFI unit of 1 thus indicates that only 1 gram of the toner passes through the orifice under the specified conditions in 10 minutes time. "MFI units" as used herein thus refers to units of grams per 10 minutes.

A number of aspects of the overall print quality are affected by the rheology, or viscoelasticity, of the toners used to develop the print. The aspects of the overall print quality affected include overall gloss level of the image, the differential gloss of the image, both within a single color and color-to-color, the fix level of the image (for example as measured by either crease or rub testing) and color-to-color fix level differences, and image quality defects associated with offset of the image, either to the fusing roll during the fusing process (hot offset) or to other surfaces after the print has exited the machine (vinyl or document offset). In addition, toner rheology also affects toner fuser roll life, i.e., the rate at which toner builds up on the toner fuser roll of an image forming device using the toner to develop images. In the present invention, the viscoelasticity is characterized by a single number, the melt flow index (MFI), as the melt flow index is on the first order an accurate reflection of the rheological properties which control the aspects of the print quality discussed above.

Prior to the present invention, the MFI of a toner has merely been outcome dependent on the formulation of the toner, including the toner composition and the additive package. This has resulted in different toners of a developer set that are to be used together in forming a color image having significantly different MFI values. These variable MFI values have resulted in a number of image quality shortfalls, particularly with respect to gloss and fix.

In an embodiment of the present invention, it is desired that the toners be used in developing an image in an image developing device utilizing a fuser roll member. Fuser roll members are contact fusing devices that are also well known in the art, in which heat and pressure from the roll are used in order to fuse the toner to an image receiving medium such as paper. In order to achieve images of high gloss while also having an acceptably long life span of the fuser roll member of the image developing device, it has been found that the MFI value of the toners used in such image developing device should all be within the range of about 11±3 MFI units, preferably about 10±2 MFI units, most preferably about 9±1 MFI units.

In the present invention, any known type of image development system may be used in an image developing device, including, for example, magnetic brush development, jumping single-component development, hybrid scavengeless development (HSD), etc. These development systems are well known in the art, and further explanation of the operation of these devices to form an image is thus not necessary herein.

Certain toners, in particular toners of the present invention with small volume median particle sizes, require higher amounts of colorant therein in order to exhibit adequate color strength. However, the amount of colorant present in a toner inversely affects the MFI of the toner such that the higher the amount of colorant in the toner, the lower its MFI value. Thus, the use of toners containing higher amounts of colorant, for example 6% by weight of dye or pigment based on the overall weight of the toner exclusive of any surface additives, results in such toners having a lower MFI compared to other toners of the developer set. For example, a developer set described in co-pending application Ser. No. 09/671,997 comprised of cyan, magenta, yellow and black toners in which the toners are all comprised of a binder of poly(propoxylated bisphenol A fumarate) polyester containing 5% crosslinked (gel) portions and the same surface additive package, but in which the respective toners contain 3.3%, 4.7%, 8.0% and 5.0% pigment by weight of the toner exclusive of surface additives, the respective toners exhibit MFI values of 14, 11, 6 and 11. The yellow toner containing the higher amount of pigment (8.0% by weight) has a low MFI value. This can lead to image quality shortfalls, particularly with respect to gloss and fix differences such as discussed above.

As noted above, the toner composition and surface additive package also affect the MFI value of the end toner. A first contributor is the amount of crosslinked portions present in the binder. As the amount of crosslinked (gel) portions in the binder increases, the MFI value of the toner decreases. Further, as the amount of colorant in the toner increases, the MFI value of the toner also generally decreases, although the magnitude of the decrease is dependent on pigment type. However, none of the unexpected benefits of the present invention, such as the extended fuser roll life, accompany the decreasing MFI value of the toner.

The additive package used, and an amount used, also affects the MFI value of the toner. In general, the greater the amount of external surface additives, the lesser the MFI value of the toner. There are thus several variables of the composition which may be manipulated in order to adjust the MFI value of the toner to a desired value. These compositional variables may also be used to compensate for variations in the MFI of the toner caused by variations in the raw materials used to make the toners, specifically gel content variations in the crosslinked portion of the resin or molecular weight variations in the linear portion of the resin, or variations in the manufacturing process, specifically the stress level on the toner during one of the processing unit operations.

As described in U.S. Pat. Nos. 5,227,460, 5,352,556, 5,376,494, 5,395,723 and 5,401,602, each incorporated herein by reference in their entireties, a low melt toner resin with low minimum fix temperature and wide fusing latitude may be prepared by including in the resin a linear portion and a crosslinked portion containing high density crosslinked microgel particles, but substantially no low density cross-linked polymer. The inclusion of the crosslinked portions is desired as these highly crosslinked dense microgel particles distributed throughout the linear portion impart elasticity to the resin which improves the resin offset properties, while not substantially affecting the resin minimum fix temperature. The low fix temperature of the toner resin is a function of the molecular weight and molecular weight distribution of the portion, and is not affected by the amount of microgel particles or degree of crosslinking. The hot offset temperature is increased with the presence of microgel particles which impart elasticity to the resin. With a higher degree of crosslinking or microgel content, the hot offset temperature increases. Such toner resins thus can provide a low melt toner with a minimum fix temperature of from about 100° C. to about 200° C., preferably about 100° C. to about 160° C., more preferably about 110° C. to about 140° C., provide the low melt toner with a wide fusing latitude to minimize or prevent offset of the toner onto the fuser roll, and maintain high toner pulverization efficiencies. The low melt toner resin preferably has a fusing latitude greater than 10° C., preferably from about 10° C. to about 120° C., and more preferably more than about 20° C. and even more preferably more than about 30° C. Such toner resins and thus toners therefrom, particularly when the low melt toner resin is a polyester, show minimized or substantially no vinyl offset. As the degree of crosslinking or microgel content increases, the low temperature melt viscosity does not change appreciably, while the high temperature melt viscosity goes up. In an exemplary embodiment, the hot offset temperature can increase approximately 30%.

However, when a toner contains higher amounts of colorant as well as crosslinked gel portions, both of which cause the MFI of the toner to be reduced, it has been difficult to obtain a toner having a satisfactorily high MFI (i.e., about 11±3).

One approach to address this has been to eliminate the crosslinked portions of toners containing higher amounts of colorant in order to achieve an MFI that is as high as possible. This was done in an embodiment of the yellow toner described in application Ser. No. 09/671,997, but still achieves only a toner MFI value of 8. The beneficial offset property advantages realized through inclusion of crosslinked portions is, of course, also sacrificed in this toner.

This invention was thus derived in an effort to achieve a toner that contains a higher amount of colorant concentration and still exhibits a satisfactorily high MFI value, particularly with respect to toners containing a binder of a polyester including both linear portions and crosslinked portions.

It has now been found by the present inventors that by utilizing a polyester having lower weight average molecular weight linear portions, i.e., a polyester having a higher MFI value, a toner containing both linear portions and crosslinked portions, as well as containing higher amounts of colorant, and still having a satisfactorily high MFI value can be obtained. An additional surprising benefit of this invention is that such a toner also enables a longer user roll member lifetime. The present invention has been developed from this discovery.

In a first embodiment of the present invention, the toner comprises a binder and at least one colorant. The binder comprises a polyester resin having linear portions and crosslinked portions of high density crosslinked microgel particles in which the linea portions have a melt flow index value of at least about 40 MFI units. The binder contains at least about 5% by weight of the crosslinked portions, and the at least one colorant comprises at least about 6% by weight of the toner exclusive of any surface additives. Such toner has a melt flow index value of about 11±3 MFI units.

The toners will now be further described in terms of the materials of the toners. The toners in the present invention are preferably comprised of at least one resin binder, appropriate colorants and preferably also an additive package comprised of one or more additives. Suitable and preferred materials for use in preparing toners of the invention that possess the properties discussed above will now be discussed.

Illustrative examples of suitable toner resins selected for the toner and developer compositions of the present invention include polyesters such as the polymeric esterification products of a dicarboxylic acid and a diol comprising a diphenol, crosslinked polyesters, and the like. The polymer resins selected for the toner compositions of the present invention include homopolymers or copolymers of two or more monomers.

As one toner resin, there are selected polyester resins derived from a dicarboxylic acid and a diphenol. These resins are illustrated in, for example, U.S. Pat. No. 3,590,000, the disclosure of which is totally incorporated herein by reference. Also, polyester resins obtained from the reaction of bisphenol A and propylene oxide or propylene carbonate, and in particular including such polyesters followed by the reaction of the resulting product with fumaric acid (reference U.S. Pat. No. 5,227,460, the disclosure of which is totally incorporated herein by reference), and branched polyester resins resulting from the reaction of dimethylterephthalate with 1,3-butanediol, 1,2-propanediol, and pentaerythritol may also preferably be used.

Most preferred as the binder resin are polyester resins containing both linear portions and crosslinked portions of the type described in U.S. Pat. No. 5,227,460, discussed immediately above, i.e., polypropoxylated bisphenol A fumarate polyesters. These resins may be prepared by either reactive extrusion as described in U.S. Pat. No. 5,227,460 or liquid reactive extrusion as described in co-pending U.S. patent application Ser. No. 09/695,861. The crosslinked portion of the binder consists essentially of microgel particles with an average volume particle diameter up to 0.1 micron, preferably about 0.005 to about 0.1 micron, as determined by scanning electron microscopy and transmission electron microscopy, the microgel particles being substantially uniformly distributed throughout the linear portions. The crosslinked portions are highly crosslinked gel particles that are not soluble in substantially any solvent such as tetrahydrofuran, toluene and the like, and is called gel. As detailed in U.S. Pat. No. 5,227,460, the binder resin is preferably substantially free of crosslinked portions which are low in crosslinking density (therefore soluble in some solvents such as tetrahydrofuran, toluene and the like), called sol.

The toner resin is thus preferably a partially crosslinked unsaturated resin such as unsaturated polyester prepared by crosslinking a linear unsaturated resin (hereinafter called base resin) such as linear unsaturated polyester resin, preferably with a chemical initiator, in a melt mixing device such as, for example, an extruder at high temperature (e.g., above the melting temperature of the resin and preferably up to about 150° C. above the glass transition temperature Tg) and under high shear.

The toner resin in this embodiment has a weight fraction of the microgel (gel content) in the resin mixture of at least about 4% by weight, preferably about 5% to about 20% by weight, more preferably about 6% to about 15% by weight. The linear portion of the resin preferably comprises low molecular weight reactive base resin of the same polyester used for forming the crosslinked portions.

The molecular weight distribution of the resin is thus bimodal, having different ranges for the linear and the crosslinked portions of the binder. The weight-average molecular weight (Mw) of the linear portion is in the range of from, for example, about 8,000 to about 14,000. The weight average molecular weight of the gel portions is, on the other hand, not generally measurable by standard analytical techniques due to the insolubility of this portion of the resin; however, it is believed to be greater than at least 300,000, Rather than in terms of molecular weight, an alternative metric is to define the melt flow index (MFI) of the linear portion of the resin. In this first embodiment, the linear portion of the resin preferably has a MFI of at least about 40 MFI units, more preferably about 42 to about 60 MFI units, as measured at 117° C. under a load of 2.16 kg. The crosslinked, gel portion has an MFI of between about 10 and about 27 MFI units as measured at 135° C. under a load of 16.6 kg (these conditions are different for the crosslinked portion because at 117° C., under a load of 2.16 kg, the MFI value would be immeasurably small for this dense gel).

This binder resin containing at least about 5% by weight crosslinked portions can provide a low melt toner with a minimum fix temperature of from about 100° C. to about 200° C., preferably about 100° C. to about 160° C., more preferably about 110° C. to about 140° C., provide the low melt toner with a wide fusing latitude to minimize or prevent offset of the toner onto the fuser roll, and maintain high toner pulverization efficiencies. The toner resins and thus toners show minimized or substantially no vinyl or document offset.

The crosslinked portion consists essentially of very high molecular weight microgel particles with high density crosslinking (as measured by gel content) and which are not soluble in substantially any solvents such as, for example, tetrahydrofuran, toluene and the like. The microgel particles are highly crosslinked polymers with a very small, if any, crosslink distance. This type of crosslinked polymer may be formed by reacting chemical initiator with linear unsaturated polymer, and more preferably linear unsaturated polyester, at high temperature and under high shear. The initiator molecule breaks into radicals and reacts with one or more double bond or other reactive site within the polymer chain forming a polymer radical. This polymer radical reacts with other polymer chains or polymer radicals many times, forming a highly and directly crosslinked microgel. This renders the microgel very dense and results in the microgel not swelling very well in solvent. The dense microgel also imparts elasticity to the resin and increases its hot offset temperature while not affecting its minimum fix temperature.

In a most preferred aspect of the first embodiment, the toner binder resin comprises a melt extrusion of (a) linear propoxylated bisphenol A fumarate resin having an MFI value of at least about 40 and (b) crosslinked portions derived from propoxylated bisphenol A fumarate resin in an overall gel content of at least about 5% by weight. A preferred linear propoxylated bisphenol A fumarate resin for this embodiment is available under the tradename SPARII from Resana S/A Industrias Quimicas, Sao Paulo Brazil.

The crosslinked gel portion may be made from the linear resin using any suitable chemical initiator such as, for example, those detailed in U.S. Pat. No. 5,227,460 and U.S. application Ser. No. 09/695,861, and the reaction may be carried out and controlled as detailed therein.

A reactive melt mixing process is a process wherein chemical reactions can be carried out on the polymer in the melt phase in a melt mixing device, such as an extruder. In preparing the binder resins, these reactions are used to modify the chemical structure and the molecular weight, and thus the melt rheology and fusing properties, of the polymer. Reactive melt mixing is particularly efficient for highly viscous materials, and is advantageous because it requires no solvents, and thus is easily environmentally controlled. As soon as the amount of cross-linking desired is achieved, the reaction products can be quickly removed from the reaction chamber.

Moreover, it should be noted that the resin may also be made by mixing linear resin with the appropriate amount of previously formed crosslinked microgel of linear resin.

The binder resins can be melt blended or otherwise mixed with a colorant (e.g., pigment or dye), charge carrier additives, surfactants, emulsifiers, pigment dispersants, flow additives, embrittling agents, and the like. The resultant product can then be pulverized by known methods such as milling to form toner particles. If desired, waxes with a molecular weight of from about 1,000 to about 7,000, such as polyethylene, polypropylene, and paraffin waxes, can be included in or on the toner compositions as fuising release agents.

Various suitable colorants of any color without restriction can be employed in toners of the invention, for example wherein the colorant is carbon black, magnetite, or mixtures thereof, cyan, magenta, yellow, blue, green, red, orange, violet or brown, or mixtures thereof, including suitable colored pigments, dyes, and mixtures thereof including Carbon Black, such as REGAL 330 carbon black (Cabot), Acetylene Black, Lamp Black, Aniline Black, Diarylide Yellow, SUNFAST YELLOW, POLYTONE YELLOW, Arylide Yellow, Chrome Yellow, Zinc Yellow, SICOFAST YELLOW, SUNBRITE YELLOW, LUNA YELLOW, NOVAPERM YELLOW, Chrome Orange, BAYPLAST ORANGE, Cadmium Red, LITHOL SCARLET, Rubines, Quanacridones, RHODAMINE LAKE C, SUNTONE MAGENTA, POLYTONE MAGENTA, HOSTAPERM RED, FANAL PINK, HOSTAPERM PINK, LITHOL RED, RHODAMINE LAKE B, Brilliant Carmine, SUNTONE CYAN, POLYTONE CYAN, HELIOGEN BLUE, HOSTAPERM BLUE, NEOPAN BLUE, PV FAST BLUE, Phthalocyanine Blue, CINQUASSI GREEN, HOSTAPERM GREEN, titanium dioxide, cobalt, nickel, iron powder, SICOPUR 4068 FF, and iron oxides such as MAPICO BLACK (Laporte Pigments, Inc.), NP608 an NP604 (Northern Pigment), BAYFERROX 8610 (Bayer), MO8699 (Mobay), TMB-100 (Magnox), mixtures thereof and the like.

In the present invention, the colorant, preferably yellow colorant, is incorporated in an amount of at least about 6% by weight of the toner, preferably about 7% by weight to about 30% by weight of the toner, exclusive of any surface additives. The weight percentage of the colorant refers to the actual weight percentage of the pigment or dye only, and not to any weight from binder or other components possibly added along with the colorant.

The toner composition is thus applicable to toners that require higher amounts of toner concentration in order to achieve a desired level of color gamut. It has been surprisingly found that such a toner can exhibit an MFI of about 11±3 MFI units while containing both at least about 5% by weight microgel content and at least about 6% by weight colorant when using a linear polyester binder resin component having the above-specified MFI parameters.

An alternate method of characterizing the toner rheology is by measurement of the equilibrium viscous modulus and equilibrium elastic modulus of the toner. For a toner of the first embodiment of the present invention, in particular one possessing all MFI value of about 9 MFI units, the melt rheology profile of the toner that is enabling has an equilibrium viscous modulus of greater than $2.0\times10^4$ dynes per square centimeter, preferably greater than $2.5\times10^4$ dynes per square centimeter, and an equilibrium elastic modulus of greater than $6.0\times10^4$ dynes per square centimeter, preferably greater than $8.0\times10^4$ dynes per square centimeter. For comparison, a toner with an equivalent MFI value of 9 but made from a linear resin possessing a 27 MFI, and for which the toner has an overall gel content of about 3% by weight, has an equilibrium viscous modulus of about $1.\times10^4$ dynes per square centimeter and an equilibrium elastic modulus of about $4.0\times10^4$ dynes per square centimeter. Both the equilibrium viscous modulus and equilibrium elastic modulus of the toner are determined by measurement using a standard mechanical spectrometer, by measurement over a range of temperatures from 100° C. to 160° C. and over a range of frequencies from 0.1 radians per second to 100 radians per second.

In a most preferred embodiment, the toner is a yellow toner in which the pigment is comprised of 30% SUNBRITE YELLOW (Pigment Yellow 17) from SUN Chemical dispersed in 70% linear propoxylated bisphenol A fumarate and is loaded into the toner in an amount of about 27% by weight (corresponding to about 8% by weight pigment loading).

Any suitable surface additives may be used in the present invention. Most preferred in the present invention are one or more of $SiO_2$, metal oxides such as, for example, $TiO_2$ and aluminum oxide, and a lubricating agent such as, for example, a metal salt of a fatty acid (e.g., zinc stearate (ZnSt), calcium stearate) or long chain alcohols such as UNILIN 700, as external surface additives. In general, silica is applied to the toner surface for toner flow, tribo enhancement, admix control, improved development and transfer stability and higher toner blocking temperature. $TiO_2$ is applied for improved relative humidity (RH) stability, tribo control and improved development and transfer stability.

The $SiO_2$ and $TiO_2$ should preferably have a primary particle size greater than approximately 30 nanometers, preferably of at least 40 nm, with the primary particles size measured by, for instance transmission electron microscopy (TEM) or calculated (assuming spherical particles) from a measurement of the gas absorption, or BET, surface area. $TiO_2$ is found to be especially helpful in maintaining development and transfer over a broad range of area coverage and job run length. The $SiO_2$ and $TiO_2$ are preferably applied to the toner surface with the total coverage of the toner ranging from, for example, about 100 to 200% theoretical surface area coverage (SAC), where the theoretical SAC (hereafter referred to as SAC) is calculated assuming all toner particles are spherical and have a diameter equal to the volume median diameter of the toner as measured in the standard Coulter counter method, and that the additive particles are distributed as primary particles on the toner surface in a hexagonal closed packed structure.

The most preferred $SiO_2$ and $TiO_2$ have been surface treated with compounds including DTMS (dodecyltrimethoxysilane) or HMDS (hexamethyldisilazane). Examples of these additives are: NA50HS silica, obtained from DeGussa/Nippon Aerosil Corporation, coated with a mixture of HMDS and aminopropyltriethoxysilane; DTMS silica, obtained from Cabot Corporation, comprised of a fumed silica, for example silicon dioxide core L90 coated with DTMS; H2050EP silica, obtained from Wacker Chemie, coated with an amino functionalized organopolysiloxane; TS530 from Cabot Corporation, Cab-O-Sil Division, a treated fumed silica; SMT5103 titania, obtained from Tayca Corporation, comprised of a crystalline titanium dioxide core MT500B, coated with DTMS.; MT3103 titania, obtained from Tayca Corporation, comprised of a crystalline titanium dioxide core coated with DTMS. The titania may also be untreated, for example P-25 from Nippon Aerosil Co., Ltd.

Zinc stearate is preferably also used as an external additive for the toners of the invention, the zinc stearate providing lubricating properties. Zinc stearate provides developer conductivity and tribo enhancement, both due to its lubricating nature. In addition, zinc stearate enables higher toner charge and charge stability by increasing the number of contacts between toner and carrier particles. Calcium stearate and magnesium stearate provide similar functions. Most preferred is a commercially available zinc stearate known as ZINC STEARATE L, obtained from Ferro Corporation, which has an average particle diameter of about 9 microns, as measured in a Coulter counter.

Preferably, the toners contain from, for example, about 0.1 to 5 weight percent titania, about 0.1 to 8 weight percent silica and about 0.1 to 4 weight percent zinc stearate. More preferably, the toners contain from, for example, about 0.1 to 3 weight percent titania, aobut 0.1 to 6 weight percent silica and about 0.1 to 1 weight percent zinc stearate.

The additives discussed above are chosen to enable superior toner flow properties, as well as high toner charge and charge stability. The surface treatments on the $SiO_2$ and $TiO_2$, as well as the relative amounts of the two additives, can be manipulated to provide a range of toner charge.

For further enhancing the negative charging characteristics of the developer compositions described herein, and as optional components there can incorporated into the toner or on its surface charge enhancing a aluminum complexes, like BONTRON E-88, and the like and other similar known charge enhancing additives. Also, positive charge enhancing additives may also be selected, such as alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; bisulfates, and the like. These additives may be incorporated into the toner in an amount of from about 0.1 percent by weight to about 20 percent by weight, and preferably from 1 to about 3 percent by weight.

While any desired toner particle size may be used, in a preferred embodiment of the invention, the finished toner particles have an average particle size (volume median diameter) of from about 5.0 to about 9.0 microns, most preferably of from about 6.0 to about 8.0 microns, as measured by the well known Coulter counter technique. The toner preferably also exhibits a narrow particle size distribution with a lower volume ratio geometric standard deviation (GSD) of approximately 1.30 or less.

A first unexpected advantage of the present invention is the fact that toners containing higher amounts of colorant and crosslinked portions can now be made that are able to extend fuser roll life, where fuser roll life is defined as the print count at which toner begins to offset, or transfer, from the image on the paper to the surface of the fuser roll. For example, a yellow toner in which the binder resin is a linear polypropoxylated bisphenol A fumarate with an MFI of about 50 and a gel content of about 8% by weight and a yellow pigment concentration of about 9% by weight, and which has an overall MFI value for the finished toner of about 8, does not interact as significantly with a fuser roll, and thus enables a fuser roll life approximately a factor of 2 longer (250 kiloprints to about 120 kiloprints) than a yellow toner having the identical MFI value and a similar composition but in which the binder resin comprises a linear polypropoxylated bisphenol A fumarate with an MFI of about 30 and a gel content of about 3% by weight. This is a particularly surprising result given that in general, it had been thought that longer fuser roll lives were enabled by lower toner MFI values. This surprising additional advantage has large economic impact given the much longer fuser roll life enabled by the toner of the invention.

A second unexpected advantage of the present invention is the fact that toners containing higher amounts of colorant and crosslinked portions can now be made that are able to extend the life of the developer donor roll in hybrid scavengeless development systems. Such a system is described in, for example, U.S. Pat. No. 5,978,633, the entire disclosure of which is incorporated herein by reference. In this case, donor roll life is defined as the print count at which a layer of toner forms on the surface of the donor roll which cannot be removed by electrostatic means but must be mechanically scrubbed off the surface of the roll, preferably in the presence of a solvent. For example, a yellow toner in which the binder resin is a linear polypropoxylated bisphenol A fumarate with an MFI of about 50 and a gel content of about 8% by weight and a yellow pigment concentration of about 9% by weight, and which has an overall MFI value for the finished toner of about 8, does not interact as significantly with a donor roll, and thus enables a donor roll life approximately a factor of 2 longer (700 kiloprints to about 350 kiloprints) than a yellow toner having the identical MFI value and a similar composition but in which the binder resin comprises a linear polypropoxylated bisphenol A fumarate with an MFI of about 30 and a gel content of about 3% by weight. This surprising additional advantage also has large economic impact given the much longer fuser roll life enabled by the toner of the invention.

In a second embodiment of the present invention, the binder component comprises a mixture of a first and a second polyester resin. In this embodiment, the toner thus comprises a binder component and at least one colorant, again wherein the at least one colorant comprises at least about 6% by weight of the toner exclusive of any surface additives as in the first embodiment discussed above. The binder component comprises about 10% to about 80% by weight of the binder of a first polyester resin having a melt flow index value less than about 35 MFI units and about 20% to about 90% by weight of the binder of a second polyester resin having a melt flow index value of at least about 40 MFI units, and wherein the toner has a melt flow index value of about 11±3 MFI units. The binder component may also contain from 0% to about 4% by weight of crosslinked microgel particles in this second embodiment.

As for the second polyester resin, it is preferably the same as the linear polyester resins discussed above. That is, the second binder resin is preferably a linear polyester resin, most preferably a polypropoxylated bisphenol A fumarate polyester resin such as SPARII. This linear polyester resin preferably has a MFI of at least about 40 MFI units, more preferably about 42 to about 60 MFI units. This polyester resin comprises from about 20% to about 90% by weight, preferably from about 35% to about 90% by weight, of the total binder amount.

As for the first polyester resin, it is also a linear polyester resin of the type discussed above in the first embodiment. In a most preferred embodiment, the first polyester resin is the same polyester as the second polyester resin for comparability, but possesses a different MFI value. Thus, in a most preferred embodiment, the first polyester resin and the second polyester resin are both linear polypropoxylated bisphenol A fumarate polyesters. The first resin differs from the second resin at least in exhibiting an MFI value of less than about 35 MFI units preferably from about 25 to about 35 MFI units, more preferably from about 28 to about 32 MFI units. This first polyester resin is present in the binder component in an amount of from about 10% to about 80% by weight, preferably from about 10% to about 65% by weight, of the binder.

The remaining components of the toner in this second embodiment, i.e., the colorant and amounts thereof, the surface additives and amounts thereof, and other optional additives may be the same as with the toner of the first embodiment described above.

The toner of this second embodiment is also able to exhibit an MFI of about 11±3 by virtue of the mixture of the higher and lower MFI valued polyester resins. Thus, for example, a toner comprised of 8% colorant and having a preferred additive package such as described above, and in which the binder comprises 100% of a linear polypropoxylated bisphenol A fumarate having an MFI value of about 30 and without any crosslinked portions may be expected to exhibit a toner MFI value of about 8. However, upon the replacement of 40% by weight of this binder with a second linear polypropoxylated bisphenol A fumarate having an MFI value of about 48, the toner MFI value may be expected to increase to about 11, and further upon the replacement of 89% by weight of this binder with a second linear polypropoxylated bisphenol A fumarate having an MFI value of about 48, the toner MFI value may be expected to increase to about 14.

As noted above, the binder component may also contain amounts of crosslinked microgel portions as in the first embodiment as a result of the higher toner MFI achievable with the mixture of binders. This is because the mixture of binders enables a higher toner MFI, and thus the decrease of MFI realized upon inclusion of small amounts of crosslinked portions can be offset and the toner can still exhibit an MFI within the desired range of about 11±3.

The toner particles of all embodiments of the invention are preferably formulated into a developer composition. Preferably, the toner particles are mixed with carrier particles to achieve a two-component developer composition. Preferably, the toner concentration in each developer ranges from, for example, 1 to 10%, more preferably 2 to 8%, by weight of the total weight of the developer.

Illustrative examples of carrier particles that can be selected for mixing with the toner composition prepared in accordance with the present invention include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Additionally, there can be selected as carrier particles nickel berry carriers as disclosed in U.S. Pat. No. 3,847,604, the entire disclosure of which is hereby totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are hereby totally incorporated herein by reference.

The selected carrier particles can be used with or without a coating, the coating generally being comprised of fluoropolymers, such as polyvinylidene fluoride resins, terpolymers of styrene, methyl methacrylate, a silane, such as triethoxy silane, tetrafluoroethylenes, other known coatings and the like.

As toners of the present invention are to be used in conjunction with an image developing device employing roll fusing, the carrier core is partially coated with a polymethyl methacrylate (PMMA) polymer having a weight average molecular weight of 300,000 to 350,000 commercially available from Soken. The PMMA is an electropositive polymer in that the polymer that will generally impart a negative charge on the toner with which it is contacted. The coating preferably has a coating weight of from, for example, 0.1 to 3.0% by weight of the carrier, preferably 0.5 to 1.3% by weight.

The PMMA may optionally be copolymerized with any desired comonomer, so long as the resulting copolymer retains a suitable particle size. Suitable comonomers can include monoalkyl, or dialkyl amines, such as a dimethylamnoethyl methacrylate, diethylaminoethyl methacrylate, diisopropylaminoethyl methacrylate, or t-butylaminoethyl methacrylate, and the like.

The carrier particles may be prepared by mixing the carrier core with from, for example, between about 0.05 to about 10 percent by weight, more preferably between about 0.05 percent and about 3 percent by weight, based on the weight of the coated carrier particles, of polymer in until adherence thereof to the carrier core by mechanical impaction and/or electrostatic attraction.

The polymer is most preferably applied in dry powder form and having an average particle size of less than 1 micrometer, preferably less than 0.5 micrometers. Various effective suitable means can be used to apply the polymer to the surface of the carrier core particles. Examples of typical means for this purpose include combining the carrier core material and the polymer by cascade roll mixing, or tumbling, milling, shaking, electrostatic powder cloud spraying, fluidized bed, electrostatic disc processing, and with an electrostatic curtain.

The mixture of carrier core particles and polymer is then heated to a temperature below the decomposition temperature of the polymer coating. For example, the mixture is heated to a temperature of from about 90° C. to about 350° C., for a period of time of from, for example, about 10 minutes to about 60 minutes, enabling the polymer to melt and fuse to the carrier core particles. The coated carrier particles are then cooled and thereafter classified to a desired particle size.

The carrier particles can be mixed with the toner particles in various suitable combinations. However, best results are obtained when about 1 part to about 5 parts by weight of toner particles are mixed with from about 10 to about 300 parts by weight of the carrier particles.

For all embodiments of the present invention, the advantage of achieving a toner having a higher toner concentration (i.e., 6% by weight or more) but still possessing an MFI of 11±3, is that all four toners of a conventional developer set (e.g., cyan, magenta, yellow and black) can be made to have melt flow index values that are substantially the same. As such, resultant color images formed using the developer set have an overall excellent image quality. In particular, the color image has an excellent overall gloss level and does not exhibit any differential gloss (distinctly different glosses among different colors) or gloss banding (variations in gloss from one area of an image to another within a single color). "Substantially the same melt flow index values" refers to those differently colored toners to be used together in developing a color image having melt flow index values of about 11±3, preferably about 10±2, more preferably about 9±1, MFI units. Thus, the developer set is fully color-blind in terms of MFI value (see U.S. application Ser. No. 09/671,997).

Although the invention has been described with reference to specific preferred embodiments, it is not intended to be limited thereto, rather those having ordinary skill in the art will recognize that variations and modifications may be made therein which are within the spirit of the invention and within the scope of the claims.

What is claimed is:

1. A toner comprising a binder and at least one colorant, wherein the binder comprises a polyester resin having linear portions and crosslinked portions of high density crosslinked microgel particles, wherein the linear portions have a melt flow index value of at least about 40 MFI units, wherein the binder contains at least about 5% by weight of the crosslinked portions, wherein the at least one colorant comprises at least about 6% by weight of the toner exclusive of any surface additives, and wherein the toner has a melt flow index value of about 11±3 MFI units.

2. The toner according to claim 1, wherein the polyester resin comprises a polypropoxylated bisphenol A fumarate.

3. The toner according to claim 1, wherein the linear portions of the binder have a melt flow index of from about 41 to about 60 MFI units.

4. The toner according to claim 1, wherein the binder contains from about 6% to about 18% by weight of the crosslinked portions.

5. The toner according to claim 1, wherein the at least one colorant is a yellow pigment.

6. The toner according to claim 1, wherein the toner has a melt flow index of about 9±1 MFI units.

7. The toner according to claim 1, wherein the toner further comprises one or more external surface additives of silicon dioxide powder, a metal oxide powder or a lubricating agent.

8. The toner according to claim 7, wherein the metal oxide powder is titanium dioxide or aluminum oxide and the lubricating agent is zinc stearate.

9. A toner comprising a binder component and at least one colorant, wherein the at least one colorant comprises at least about 6% by weight of the toner exclusive of any surface additives, wherein the binder component comprises about 10% to about 80% by weight of a first polyester resin having a melt flow index value of from less than about 35 MFI units and about 20% to about 90% by weight of a second polyester resin having a melt flow index value of at least about 40 MFI units, and wherein the toner has a melt flow index value of about 11±3 MFI units.

10. The toner according to claim 9, wherein both the first polyester resin and the second polyester resin comprise the same polyester.

11. The toner according to claim 9, wherein both the first polyester resin and the second polyester resin comprise a polypropoxylated bisphenol A fumarate.

12. The toner according to claim 9, wherein the binder component further contains from 0% to about 4% by weight of crosslinked portions.

13. The toner according to claim 9, wherein the at least one colorant is a yellow pigment.

14. The toner according to claim 9, wherein the toner has a melt flow index of about 9±1 MFI units.

15. The toner according to claim 9, wherein the toner further comprises one or more external surface additives of silicon dioxide powder, a metal oxide powder or a lubricating agent.

16. The toner according to claim 15, wherein the metal oxide powder is titanium dioxide or aluminum oxide and the lubricating agent is zinc stearate.

17. A developer set comprising at least four differently colored toners for use in a same image developing device, wherein each of the at least four differently colored toners comprises a binder component and at least one colorant, wherein each of the at least four differently colored toners has a melt flow index value of about 11±3 MFI units, and wherein at least one of the differently colored toners comprises the toner according to claim 1.

18. The developer set according to claim 17, wherein the melt flow index value is from about 9±1 MFI units.

19. The developer set according to claim 17, wherein the differently colored toners are cyan, magenta, yellow and black toners.

20. The developer set according to claim 19, wherein the at least one of the differently colored toners is the yellow toner.

21. The developer set according to claim 17, wherein each of the differently colored toners is mixed with a carrier.

22. The developer set according to claim 17, wherein each of the differently colored toners include a linear polyester binder comprised of a polypropoxylated bisphenol A fumarate.

23. A developer set comprising at least four differently colored toners for use together in a same image developing device, wherein each of the at least four differently colored toners comprises a binder component and at least one colorant, wherein each of the at least four differently colored toners has a melt flow index value of about 11±3 MFI units, and wherein at least one of the differently colored toners comprises the toner according to claim 9.

24. The developer set according to claim 23, wherein the melt flow index value is from about 9±1 MFI units.

25. The developer set according to claim 23, wherein the differently colored toners are cyan, magenta, yellow and black toners.

26. The developer set according to claim 25, wherein the at least one of the differently colored toners is the yellow toner.

27. The developer set according to claim 23, wherein each of the differently colored toners is mixed with a carrier.

28. The developer set according to claim 23, wherein each of the differently colored toners include a linear polyester binder comprised of a polypropoxylated bisphenol A fumarate.

* * * * *